US006745714B1

(12) United States Patent
Faber

(10) Patent No.: US 6,745,714 B1
(45) Date of Patent: Jun. 8, 2004

(54) CONTROL FOR VARIABLE BUOYANCY FLOATING DOCK

(75) Inventor: David T. Faber, Cleveland, OH (US)

(73) Assignee: Jet Dock Systems, Inc., Cleveland, OH (US)

( * ) Notice: Subject to any disclaimer, the term of this patent is extended or adjusted under 35 U.S.C. 154(b) by 143 days.

(21) Appl. No.: 10/033,249

(22) Filed: Oct. 29, 2001

(51) Int. Cl.[7] ..... B63B 35/44
(52) U.S. Cl. ..... 114/263; 405/219
(58) Field of Search ..... 114/45, 46, 263, 114/266, 267; 405/219, 221; 14/27, 28

(56) References Cited

U.S. PATENT DOCUMENTS

| | | | | |
|---|---|---|---|---|
| 1,791,305 A | | 2/1931 | Gerli | |
| 2,430,178 A | | 11/1947 | Kurfiss | |
| 2,453,155 A | | 11/1948 | Nelson et al. | |
| 2,692,101 A | | 10/1954 | Doolittle et al. | |
| 2,742,012 A | | 4/1956 | Bridges | |
| 2,894,472 A | | 7/1959 | Foster | |
| 3,276,211 A | | 10/1966 | Drake | |
| 3,358,884 A | | 12/1967 | Link | |
| 3,788,254 A | | 1/1974 | Sheil | |
| 3,824,644 A | | 7/1974 | Stranzinger | |
| 3,951,087 A | * | 4/1976 | Carson | 114/45 |
| 3,977,030 A | | 8/1976 | Ringdal | |
| 4,018,179 A | | 4/1977 | Rutter | |
| 4,510,877 A | * | 4/1985 | Bloxham | 114/45 |
| 4,604,962 A | | 8/1986 | Guibault | |
| 4,655,156 A | | 4/1987 | Svirklys et al. | |
| 5,125,355 A | | 6/1992 | Stranzinger | |
| 5,174,234 A | | 12/1992 | Ryan | |
| 5,183,001 A | | 2/1993 | Stranzinger | |
| 5,529,013 A | | 6/1996 | Eva, III et al. | |
| 5,682,833 A | | 11/1997 | Eva, III et al. | |
| 5,860,379 A | * | 1/1999 | Moody | 114/54 |
| 5,860,765 A | | 1/1999 | Cruchelow et al. | |
| 5,911,542 A | | 6/1999 | Obrock et al. | |
| 5,931,113 A | | 8/1999 | Eva, III et al. | |
| 5,947,050 A | | 9/1999 | Eva, III et al. | |

FOREIGN PATENT DOCUMENTS

| | | |
|---|---|---|
| FR | 929685 | 7/1947 |
| GB | 2 009 055 A | 6/1979 |

OTHER PUBLICATIONS

European Search Report for counterpart European Patent Application No. PCT/US02/18625.

* cited by examiner

*Primary Examiner*—Andrew Wright
(74) *Attorney, Agent, or Firm*—Rettner, Otto, Boisselle & Sklar

(57) ABSTRACT

A floating drive on dry dock includes a variable buoyancy beam positioned below the deck of the dock. The beam is formed of separate cells that can be filled with air from a common feeder line. Separate inlet risers allow air into each cell. As the air moves into each cell, water is displaced out an opening in the bottom of the cell. The flow of air and water is restricted or damped to assure even filling of the cells in a beam. The feeder line and risers can be back filled with water to limit air flow between cells. Multiple beams can be used to achieve the desired buoyancy.

21 Claims, 4 Drawing Sheets

CONTROL FOR VARIABLE BUOYANCY FLOATING DOCK

FIELD OF THE INVENTION

The present invention relates to floating docks with variable buoyancy.

BACKGROUND OF THE INVENTION

Floating drive on dry docks are known in the art. One such dock is shown in U.S. Pat. No. 5,931,113. That dock is assembled from a number of flotation units which are airtight. These flotation units come in two sizes, so-called full cubes and half cubes. Through selective arrangement of these units in a single layer a wide variety of watercraft can be accommodated.

As disclosed in U.S. Pat. No. 5,931,113, some watercraft, especially larger, heavier craft, require more buoyancy, particularly in the aft region of the dock, than a single layer of flotation units can provide in order for the dock to satisfactorily support the craft out of the water. The required buoyancy can be provided by one or more additional rows of floatation units placed on their sides to form a supporting beam. This beam, fastened at its outboard ends to the upper layer of flotation units, provides the added lift necessary for such heavier boats. In addition to providing lift, the beam illustrated in U.S. Pat. No. 5,931,113 provides stiffness across the width of the dock.

The floating drive on dry dock of the type illustrated in U.S. Pat No. 5,931,113 relies on flexible joints between the flotation units to enable a watercraft to drive onto the dock. At the start of the drive on operation the craft presses down against the aft end of the dock while the forward end of the dock remains essentially flat upon the water. In side elevation view, the aft end of the dock curves downward, forming a ramp for the boat to be driven on.

As the boat moves up the ramp and onto the dock, the dock flattens out and the entire boat is lifted out of the water. In addition, the '113 patent suggests that a beam with variable buoyancy may be used. An air compressor can be used to feed air through a manifold to the floatation units, and the buoyancy of the beam can be adjusted with each use. Experience has shown that such a system may not lift evenly and under uneven loads it may also list to one side or the other, and fail to return to a flat trim.

SUMMARY OF THE INVENTION

The present invention provides a floating drive on dry dock formed of flotation cells and including a group of flotation cells that may be selectively filled with air to increase their buoyancy after a boat has been driven onto the dock. The invention further provides a system for supplying air through a manifold to each of the adjustable buoyancy cells and for limiting movement of air between cells when a load is applied to them unevenly. These results are achieved by assuring that air flows into the cells more or less evenly, and by back filling the manifold with water after the cells have been inflated to the desired degree of buoyancy.

These and other features will become clearer from the specification that follows describing preferred embodiments of the invention when taken together with the accompanying drawings.

DESCRIPTION OF PREFERRED EMBODIMENTS

Figure 1:
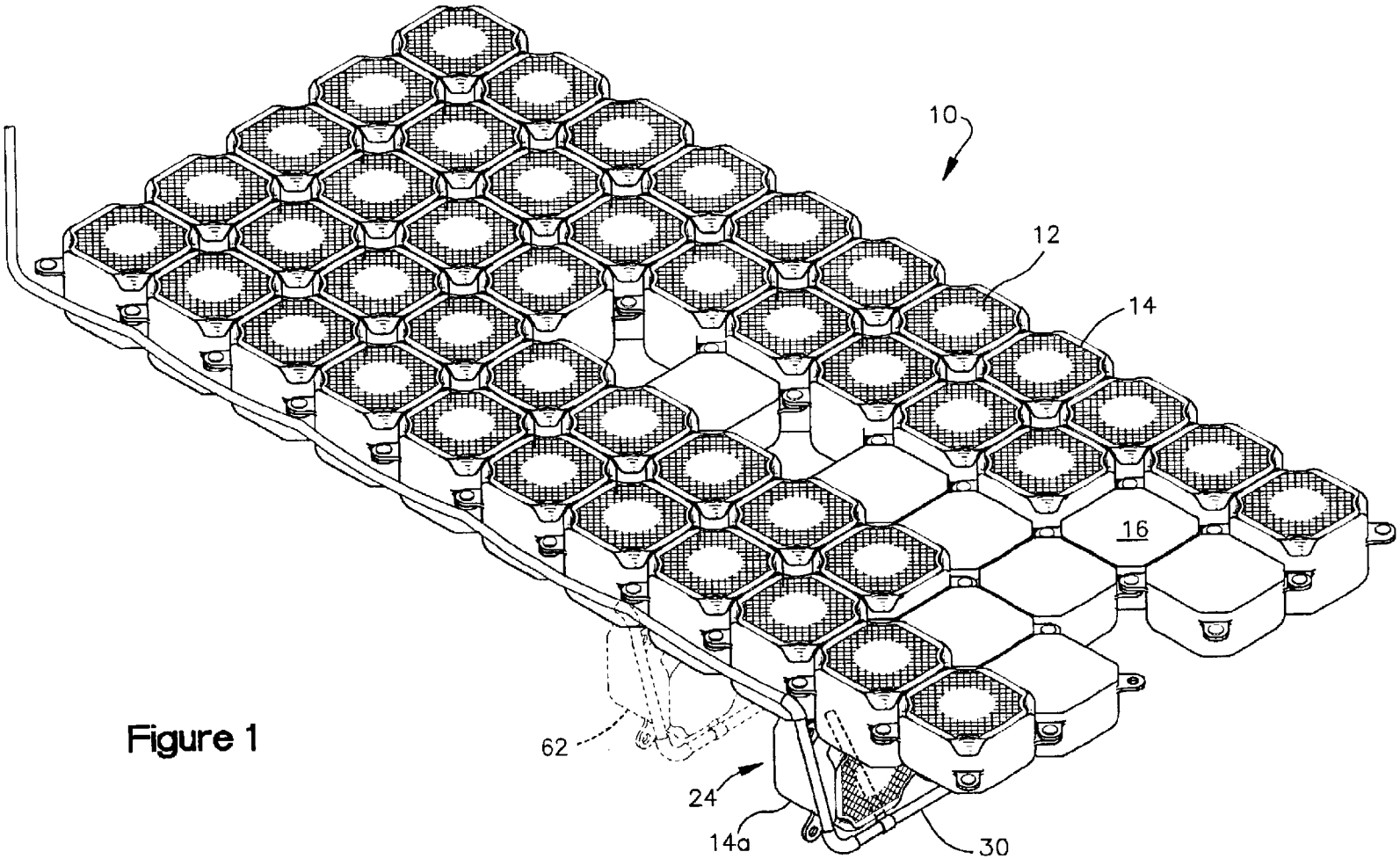
FIG. 1 illustrates a floating drive on dry dock assembled from floatation cells with an adjustable buoyancy beam suitable for using the present invention.

The floating drive on dry dock 10 shown in FIG. 1 includes a deck 12 formed of flexibly joined, floatation cells 14, 16 arranged in a rectangular array. As illustrated, the grid of cells is five cells wide and 11 cells long, though the boat for which the dock is intended determines the exact length and width.

Docks using the present invention are especially suited for boats up to about 38 feet long and weighing up to about 12000 lbs. Boats shorter than about 27 feet and weighing less than about 8000 lbs generally do not require the present invention in order to be satisfactorily dry docked. Most of the flotation cells 14 forming the dock are roughly cubic. Other cells 16 are square in plan view and a little more than half as tall as the cubic cells. The conformation, use, and arrangement of these cells is described in U.S. Pat. No. 5,931,113, the entire disclosure of which is incorporated herein by reference.

The dock 10 includes a beam 24 that is similar in some respects to the beam of U.S. Pat. No. 5,931,113. The beam 24 is positioned to provide stiffness to the dock 10 from side to side. The cells 14*a–e* (FIG. 2). of the beam 24 may be filled with water so that they tend to sink, or a controllable amount of air may be put in the cells to provide the requisite lift The present invention uses a manifold 26 to conveniently fill the cells 14*a–e* simultaneously and uniformly. In addition, each cell 14*a–e* can be isolated from each other cell so that migration of air between cells is limited and so a permanent list to one side or the other is inhibited.

The dock 10 is fitted with a manifold 26 that connects to each of the cells 14*a–e* forming the beam 24. Through operation of a valve assembly 28 (FIGS. 1 and 2), the manifold 26 can be supplied with either air under pressure, water under pressure, or allowed to vent the air to the atmosphere. The manifold 26 includes a single feeder line 30 (FIG. 2) running widthwise along the lower, aft edge of the beam 24. The feeder line 30 is held in place by any suitable fastener (not shown).

Figure 2:
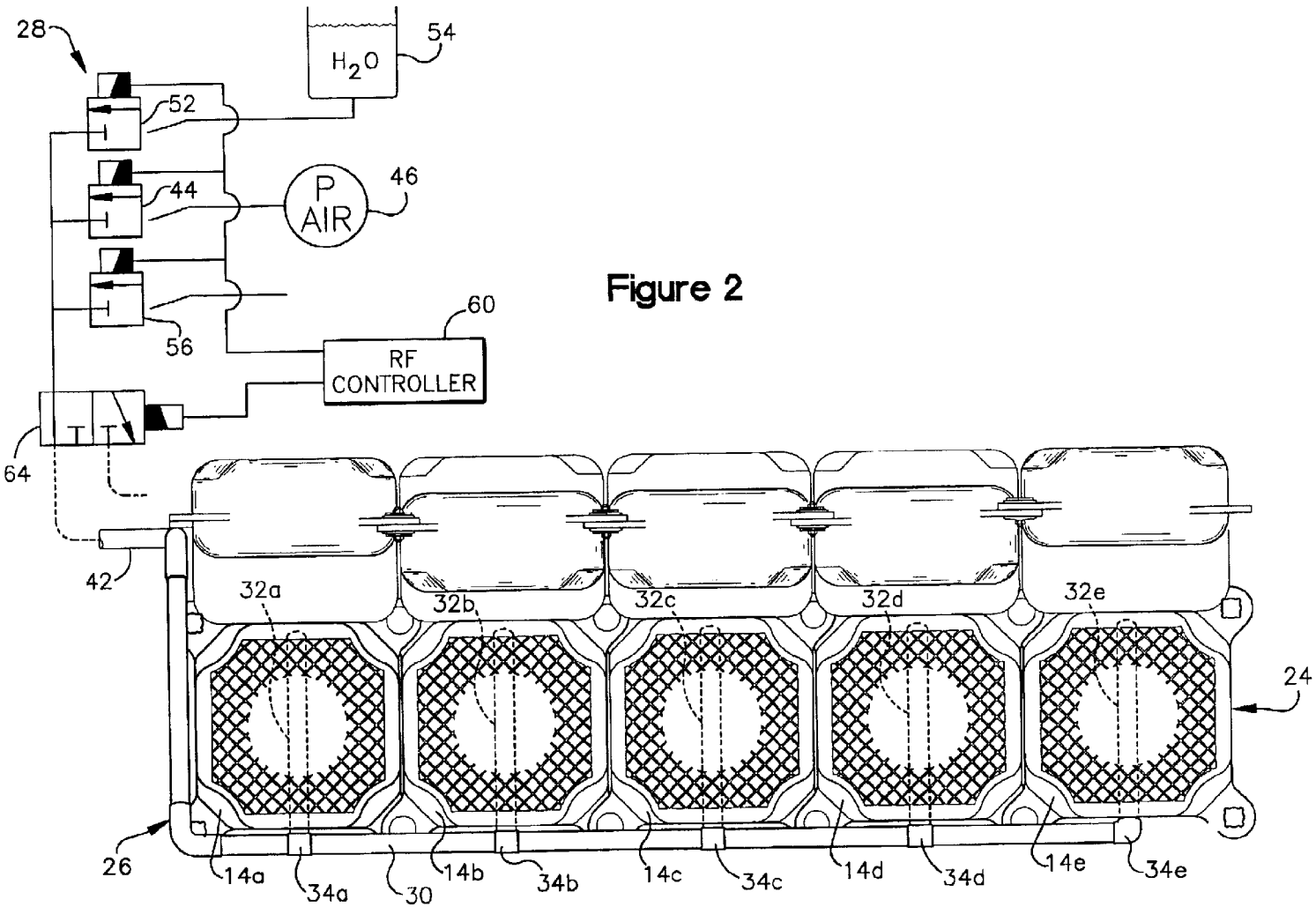
FIG. 2 is a view of the dock of FIG. 1 looking from the aft end toward the forward end and showing the control system of the present invention.
Figure 3:
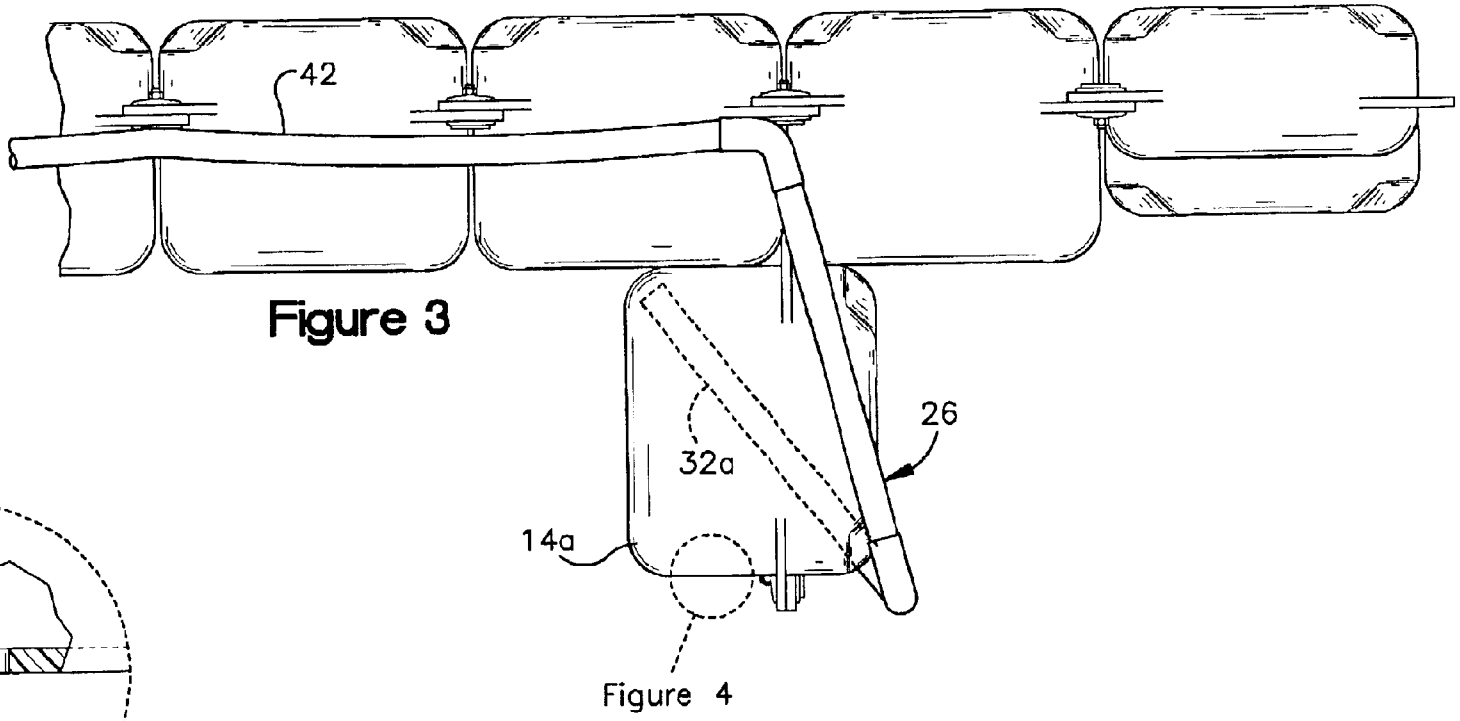
FIG. 3 is a side elevation view of the aft portion of the dock shown in FIG. 1 in a maximum buoyancy conformation.

The manifold 26 also includes an inlet riser 32*a–e* (FIG. 2) inside each cell. The feeder line 30 has a fitting 34*a–e* for each cell 14*a–e* connecting a respective inlet riser 32*a–e* to the feeder line 30. The risers 32*a–e* extend upward from the lower aft corners of the cells 14*a–e* to the upper forward corners as shown in FIGS. 2 and 3. As a result each inlet riser 32*a–e* provides. a column inside its respective cell which is higher at its outlet end than where it enters the cell. As discussed below, the inlet risers 32*a–e* may be filled with water after the cells have been filled with air, and the water in the risers prevents or limits air flow between cells.

Figure 4:
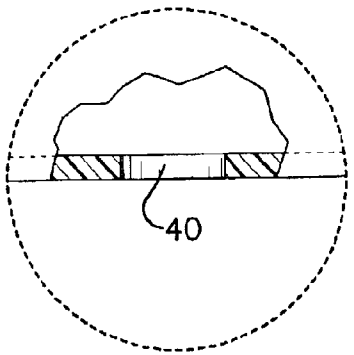
FIG. 4 is an enlarged sectional view of a portion of a floatation cell showing a drain opening.

Each cell has a drain opening 40 (FIG. 4) in its lower wall which allows water or air to move in or out of the cell. The drain opening 40 permits the flow of water out of the cell, but at a restricted rate. The size of the drain opening is selected so that the flow of water out of the cell is damped while air is being blown in in order to assure that all cells fed by a single manifold 30 fill at approximately the same rate. With a blower which can provide about an 8' head and 10–30 CFM at 3:5 psig, a ⅞" hole has proven satisfactory. Such a system filling a beam formed of, e.g. 5 cells requires only a few minutes to fill all the cells 14*a–e* with air.

As noted above each cell 14*a–e* is fitted with an inlet riser. Each inlet riser 32*a*–e may pass through a separate, water-tight opening in the lower portion or the upper portion of its cell. However, it is preferred to mount the inlet riser so that it passes through an opening in the lower aft portion of the cell 14*a–e* which is made slightly larger than the outside diameter of the inlet riser 32*a–e*. For example, the inlet risers 32*a–e* could have an outside diameter of three quarters of an inch, and the holes in the cells 14*a–e* could be ⅞ or 1" in diameter. With this arrangement a clearance is left between each opening and the inlet riser passing through it. The clearance helps to accommodate manufacturing tolerances as well as the slight bending that occurs when the dock is in use. Moreover, it is not necessary to seal the opening where the riser 32*a–e* enters the cells 14*a–e* because the openings are in the lowermost part of the cells and therefore cannot affect how much air is contained in the cell. If the clearance around the inlet riser 32*a–e* is made larger, then the size of the drain opening 40 may be reduced.

The inlet risers 32*a–e* and drain opening 40 are arranged so that when air is pumped into the cells 14*a–e*, the water inside the cells is displaced and exits through the holes in the bottom. Conversely, when the air inside the cells is allowed to vent to the atmosphere, water flows in through the holes 40 in the bottoms of the cells 14*a–e*.

Figure 5:
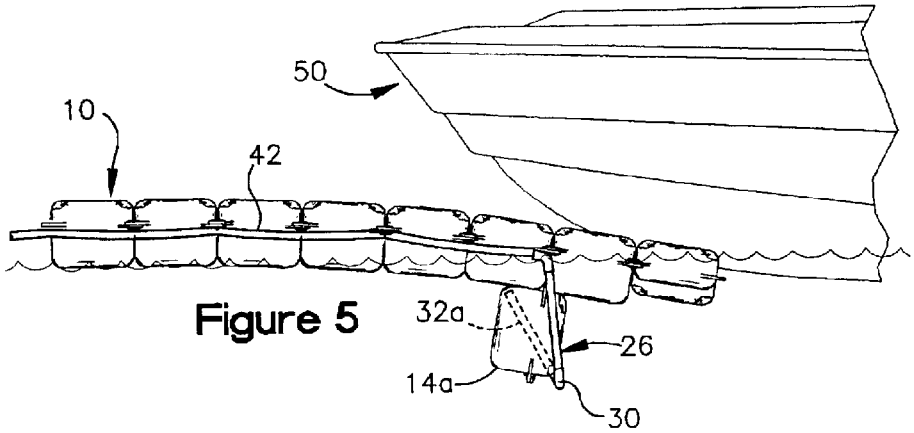
FIG. 5 is a view of the dock of FIG. 3, but with the aft portion of the dock partially submerged by the bow of a boat.

When the dock 10 is in the downwardly curved position shown in FIG. 5, the feeder line 30 is approximately at the lowest point on the beam, and the top ends of the inlet risers 32*a–e* are in the uppermost forward corner of their respective cells 14*a–e*. This arrangement assures that as air is pumped in through the inlet riser 30 into the cells 14*a–e*, all or most of the water inside each cell can be forced out. In addition, when the manifold 26 is backfilled with water as discussed below, the diagonal orientation of the inlet risers 32*a–e* assures that the maximum height column of water is in the riser. Of course, the inlet risers 32*a–e* could be located otherwise. For example, they could extend vertically along the forward or aft walls of the cells 14*a–e*. These arrangements are not as favorable as the diagonal arrangement shown in the figures because the volume of water in a riser mounted to one of the vertical cell walls is not as great as the in the diagonal mounting arrangement and because some means would be required to hold the riser against the inside wall of the cell, rather than relying on the upper corner of the cell to do that job. However they are mounted, the inlet risers 32*a–e* extend from a lower portion to an upper portion of their respective cells 14*a–e* and so contain a column of water when back filled as discussed below.

Air can be forced to the manifold 26 by a flexible pipe 42 (FIG. 3) or hose that leads through a valve assembly 44 to a source 46 of air at super-atmospheric pressure. To provide maximum lift, air is pumped into the cells 14 *a–e* until substantially all of the water has been displaced. If the air supply is simply shut off when all of the water has been displaced from the cells 14*a–e*, it is possible for the beam 24 to list. For example if a load is applied to the dock 10 unevenly from side to side, then one side would sink a little, raising the pressure inside the cells on that side of the beam 24 and forcing air through the manifold 26. This air would pass through the manifold 26 and emerge from the inlet risers 32*a–e* in cells 14*a–e* at the other end of the beam 24 that have lower pressure. This additional air would bubble through the opening 40 in the bottom of the cells and escape to the atmosphere. The result is that cells on the side where a load was applied now have less air than before. When the uneven load is relieved, the system has a tendency not to return completely to a balanced condition but to retain the list. Repeated cycles result in increased listing.

The present invention inhibits or prevents listing. This is done first by assuring that the cells fill with air substantially uniformly. To this end the feeder line 30 has across section for air flow which is substantially larger than the cross section for air flow of the risers 32*a–e*. For example, the feeder line 30 may have an internal diameter of one inch while the risers 32*a–e* have an intenal cross section of one half inch. The resulting four to one area ratio assures that the cells at the end of the feeder line (e.g., 14*d* and 14*e*) get the same air supply as those closest to the pump (e.g., 14*a* and 14*b*).

Second, as noted above, the area for flow of water out of cells is damped by the size of the openings 40 (FIG. 4) in the bottom of the cells. As air is blown into the cells 14*a–e*, water is forced out the openings 40 in the bottom of each cell. In the initial part of this process, the flow rates are predominantly controlled by the size of the drain openings in each cell. Specifically, it is the restricted size of the openings 40 in the cells for water outflow that assures the cells fill with air more or less evenly. The flow rate of air through the risers 32*a–e* is below that at which the cross sectional flow area of the riser would cause a loss of head and so affect the flow rate of air through the risers. Accordingly, the air pressure at the top of the risers 32*a–e* is substantially the same as in the inlet feed pipe 30 at this stage, and the air flow rate is controlled by how fast the water can exit through the drain holes 40. This condition continues until the first cell 14 is completely filled with air.

Once the first cell gets completely filled with air, the situation changes somewhat because the air flowing into that first-filled cell can bubble out of the drain opening 40 relatively freely. The drain opening 40 that provided resistance to the outflowing water provides substantially less resistance to the flow of air because of the density and viscosity differences between water and air. At that time, the pressure in the first air-filled cell matches the water pressure at the drain opening. Air flow through that cell's riser increases because of the lack of resistance to flow at the drain opening 40, and the airflow is now limited by the cross-section of the riser and reaches a steady rate. As a result, the air flow into that first-filled cell may increase slightly, and the air flow to the other risers decreases slightly. The large volume of air available in the feeder line 30 means that there is a sufficient volume of air to supply both the first filled cell at its steady rate and the other cells where the flow rate is still controlled predominantly by the rate at which water can flow out of the cell drain openings. This remains true as each cell empties of water and reaches a steady maximum air flow rate. Within a short time, all the cells 14*a–e* are completely filled with air.

Once the cells 14*a–e* are filled with air, flow between cells is blocked. This is done by back filling the manifold 26 with water. When water fills the manifold 26 and an uneven load is applied to the dock 10, only a small volume of water moves through the manifold 26, and as a result, the dock tends to return closely to its initial position. To accomplish this the valve assembly 28 shown schematically in FIG. 2 controls the flow through the manifold 26. The valve assembly 44 allows either air to be supplied to the manifold 26, water to be supplied to the manifold, the manifold to be vented to atmosphere, or simply closed off. To isolate each cell 14*a–e* from pressure variations in the other cells, once the manifold is back filled with water, each valve in the valve assembly 28 is shifted to its closed position.

Figure 6:
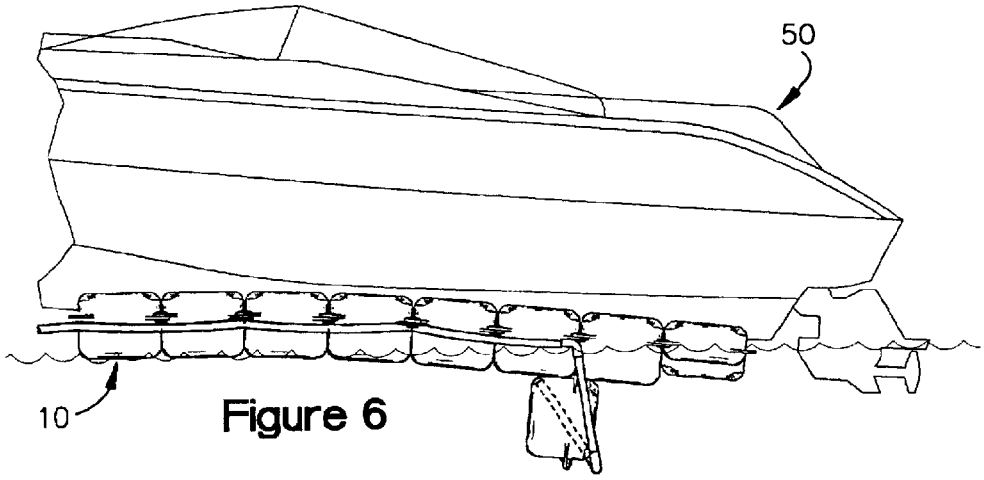
FIG. 6 is a view of the dock of FIG. 3 but with a boat on the dock and prior to adding buoyancy to the dock.
Figure 7:
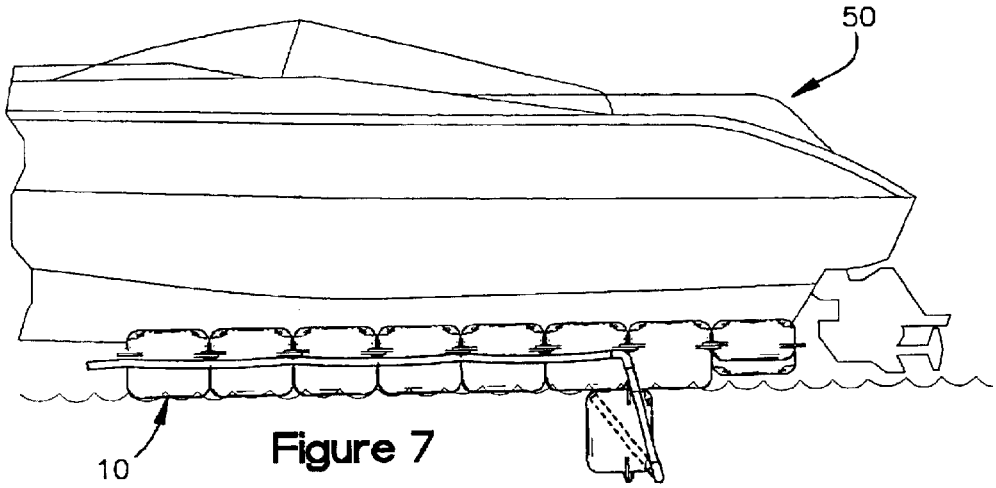
FIG. 7 is a view of the dock of FIG. 3 with a boat on the dock and lifted out of the water by the dock.

In practice before a boat is driven onto the dock 10, the dock floats level, high in the water, and the beam 24 is filled with water. When a boat 50 approaches the dock, the bow of the boat pushes the aft end of the dock 10 downward, as shown in FIG. 5. When the boat 50 is driven all the way onto the dock 10, the aft end of the dock is still submerged, as shown in FIG. 6. Once the boat is on the dock (FIG. 6), it can be secured, and then the air valve 44 (FIG. 2) is opened and air is blown into the cells 14*a–e* through the manifold's inlet risers 32*a–e*, displacing the water within the cells. The water in the cells escapes out the bottom of the cells through the drain holes 40 and the holes that surround the inlet risers. This continues until the dock 10 is in the position shown in FIG. 7 or until the desired lift is achieved. Next, the air valve 44 (FIG. 2) is closed, and the water valve 52 is opened to connect the water supply 54 to the manifold 26. Water is forced through the feeder line 30 and into the inlet risers 32*a–e*, pushing air out in front of it. This causes continued displacement of air (or water) from the cells 14*a–e*. When the feeder line 30 and inlet risers 32*a–e* are completely full of water, the water valve 52 is closed, and all fluid flow is blocked.

When this state is reached, the volume of air in each cell is essentially locked. If a trim threatening a load is applied to one side of the dock 10, the pressure will go up in the cells on that side of the dock slightly and some small amount of water may move through the manifold 26 into the cells with lower pressure. However, because water is much denser than air and the pressure inside a cell goes up only a little bit as the cell is forced downward, only a very small amount of water moves. Accordingly, the volume of air in each cell changes only very slightly. Once the uneven load is released, the cells return to their previous trim because the volume of air in all the cells is still substantially the same.

When it is time to re-submerge the dock 10, the exhaust valve 56 is opened to connect the manifold to the atmosphere. Then ambient water pressure forces first the back filled water and then air back through the inlet risers 32*a–e* into the feeder line 30 and from there are through the valve 56 to the atmosphere as the cells 14*a–e* slowly submerge.

The air, water, and exhaust valves 44, 52 and 56 are shown as being separate solenoid controlled valves, each with an open and closed position. They may alternatively be integrated into a single spool valve in a single housing. A radio frequency (RF) controller 60 like that used to operate a garage door from an automobile may control the air, water and exhaust valves. Alternatively the valves 42, 52, and 56 may be hand operated.

A conventional compressor or blower 46 can supply air. The actual pressure required is not large, on the order of 3.5 pounds per square inch. Accordingly, a centrifugal fan or blower has proven sufficient to inflate the cells. As with the air, the water used to fill the manifold need not be under tremendous pressure. Most marinas have a fresh water supply available, and the ordinary pressure of such systems is sufficient.

The dock 10 has been shown with a single variable buoyancy beam. The system of the present invention is adaptable to additional beams (e.g., beam 62, FIG. 1) to provide additional buoyancy for larger boats. Such beams may be placed at desired intervals under the length of the dock until sufficient buoyancy has been achieved. With several beams, boats of up to about 38 feet and 12,000 lbs. can readily be accommodated. If more than one beam is used, they can be connected to a single hose 42 so all cells fill simultaneously. However it may prove desirable to better control the lifting process by filling the cells with air one beam at a time. In this case, a solenoid-controlled valve 64 or manually operated valves are included to direct the flow of air and water to one beam at a time.

What is claimed is:

1. A floating drive on dry dock comprising:

a flexible-deck defining a craft receiving surface, at least two variable buoyancy flotation cells located below the deck, each of the cells having a lower portion and an upper portion, an opening in the lower portion of each floatation cell, in each cell an inlet riser having an outlet in an upper portion of the cell, a feeder line positioned below the upper portions of the cells and connected to the inlet risers, a source of air at super-atmospheric pressure, a source of-water at super-atmospheric pressure, a first valve connecting the air source to the feeder line, a second valve connecting the water source to the feeder line, and a third valve connecting the feeder line to the atmosphere.

2. The dry dock of claim 1 in which the inlet risers extend from the lower portion to the upper portion of each flotation cell.

3. The dry dock of claim 2 in which the inlet risers are located within the flotation cells.

4. The dry dock of claim 1 wherein the deck has an aft end and a forward end, the craft receiving surface includes a path extending from the aft end toward the forward end, and the dock further includes a beam extending transverse to the path, the beam being secured to the deck to limit its flexing in one direction.

5. The dry dock of claim 4 wherein the beam includes the at least two variable buoyancy flotation cells.

6. The dry dock of claim 5 including at least two beams.

7. The dry dock of claim 6 including at least one valve for selectively connecting one or the other of the beams to the source of air, to the source of water, or to the atmosphere.

8. The dry dock of claim 4 wherein the flotation cells are rigid and hollow, and wherein the beam includes a plurality of the flotation cells.

9. The dry dock of claim 8 wherein the deck is formed of a rectangular array of air-tight flotation cells and the beam extends across the width of the deck.

10. The dry dock of claim 1 where in the first, second and third valves are combined in a single housing.

11. The dry dock of claim 1 wherein the deck is formed of flotation cells that are substantially cubic and connected to each other with flexible tabs extending from the vertical edges of the cubes.

12. A method of dry docking a boat including the steps of providing a dock having a flexible deck and at least two variable buoyancy flotation cells located below the deck, each cell having an inlet riser extending from its lower portion toward its upper portion and an opening in a lower portion of each cell in communication with the surrounding water, the dock further including a single feeder line connected to all of the risers, driving a boat onto the deck while the flotation cells are in a relatively less buoyant condition, forcing water out of the cells by forcing air through the feeder line and into the cells to increase the cells buoyancy, and thereafter filling the feeder line and risers with water.

13. The method of claim 12 wherein the step of forcing water out of the cells includes forcing the water out through the opening in a lower portion of each cell.

14. A floating drive on dry dock having a flexible deck and at least two variable buoyancy flotation cells mounted below the deck, a manifold connected to the cells, a supply of air selectively connected to the manifold to adjust the buoyancy of the cells, and means for back filling the manifold with water to isolate the cells from each other.

15. A variable buoyancy beam for use with a floating drive on dry dock;

the beam including a plurality of cells connected to each other and each having an upper portion and a lower portion, a drain hole in the lower portion of at least two of the cells;

a feeder line disposed below the upper portion of the cells;

inlet risers connected to the feeder line and extending into the cells;

a source of air under pressure selectively connectable to the feeder line;

restriction means for assuring that, when the source of air is connected to the feeder line, water is displaced from cells with drain holes substantially uniformly; and a source of water under pressure selectively connectable to the feeder line.

16. The beam of claim 15 wherein the drain hole is sized to dampen the flow of water out of the cell.

17. The beam of claim 16 wherein the restriction means includes the inlet risers having a smaller cross section for flow than the feeder line.

18. The beam of claim 15 wherein the restriction means includes the inlet risers having a smaller cross section for flow than the feeder line.

19. A floating drive on dry dock including a plurality of beams as set forth in claim 15.

20. The dry dock of claim 19 wherein the dry dock includes a deck formed of closed flotation cells flexibly connected to each other.

21. The dry dock of claim 19 including valves selectively operable to connect the source of air under pressure to each of the beams.

* * * * *